US006908244B2

(12) United States Patent
Cook et al.

(10) Patent No.: US 6,908,244 B2
(45) Date of Patent: Jun. 21, 2005

(54) SPLIT PAPER SUPPORT

(75) Inventors: Brian Dale Cook, Nicholasville, KY (US); Jay Scott Siekmann, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 25 days.

(21) Appl. No.: 10/242,339

(22) Filed: Sep. 12, 2002

(65) Prior Publication Data

US 2004/0052567 A1 Mar. 18, 2004

(51) Int. Cl.[7] ..... B41J 11/58

(52) U.S. Cl. ..... 400/624; 400/642; 400/647; 271/145; 271/162; 271/171

(58) Field of Search ..... 400/624, 625, 400/626, 642, 647, 663; 271/145, 162, 163, 164, 171, 16

(56) References Cited

U.S. PATENT DOCUMENTS

| | | | | |
|---|---|---|---|---|
| 4,373,711 | A | * | 2/1983 | Foster et al. ..... 271/171 |
| 4,457,507 | A | | 7/1984 | Ishikawa et al. |
| 4,540,297 | A | | 9/1985 | Imaizumi et al. |
| 4,583,873 | A | | 4/1986 | Parks et al. |
| 4,619,388 | A | | 10/1986 | Ono et al. |
| 4,714,243 | A | | 12/1987 | Staniszewski |
| D318,875 | S | | 8/1991 | Kikkawa et al. |
| D321,901 | S | | 11/1991 | Uchibori et al. |
| D321,902 | S | | 11/1991 | Ono et al. |
| D323,184 | S | | 1/1992 | Sugawara |
| 5,085,419 | A | | 2/1992 | Bell |
| 5,111,252 | A | * | 5/1992 | Hamada et al. ..... 399/393 |
| D330,385 | S | | 10/1992 | Umino |
| 5,387,043 | A | | 2/1995 | Fujioka et al. |
| D357,273 | S | | 4/1995 | Hocking |
| 5,437,444 | A | | 8/1995 | Kawakami et al. |
| 5,454,555 | A | * | 10/1995 | Kiyohara et al. ..... 271/9.01 |
| 5,511,770 | A | | 4/1996 | Okazaki |
| 5,537,195 | A | | 7/1996 | Sagara et al. |
| 5,567,068 | A | | 10/1996 | Egashira et al. |
| D381,679 | S | | 7/1997 | Dubson |
| 5,897,113 | A | | 4/1999 | Kondo et al. |
| 5,938,190 | A | | 8/1999 | Campbell et al. |
| 5,975,520 | A | * | 11/1999 | Shim ..... 271/171 |
| 6,040,919 | A | * | 3/2000 | Iwata et al. ..... 358/400 |
| 6,056,286 | A | * | 5/2000 | Koga ..... 271/145 |
| 6,082,730 | A | | 7/2000 | Campbell et al. |
| 6,089,772 | A | | 7/2000 | Takemura et al. |
| 6,106,178 | A | | 8/2000 | Chiu |
| 6,109,606 | A | | 8/2000 | Johnson et al. |
| 6,296,407 | B1 | | 10/2001 | McKay et al. |
| 6,371,611 | B1 | | 4/2002 | Billings et al. |
| 6,582,139 | B2 | * | 6/2003 | Abe et al. ..... 400/599.1 |

* cited by examiner

*Primary Examiner*—Andrew H. Hirshfeld
*Assistant Examiner*—Dave A. Ghatt
(74) *Attorney, Agent, or Firm*—Taylor & Aust PC

(57) ABSTRACT

A printer paper support system includes a housing, a first paper support pivotally attached to the housing and a second paper support pivotally attached to the housing, the second paper support extending the first paper support.

3 Claims, 2 Drawing Sheets

SPLIT PAPER SUPPORT

BACKGROUND OF THE INVENTION

1. Field of the Invention

The present invention relates to a printer, and, more particularly, to an apparatus and method for utilizing a split paper support on a printer.

2. Description of the Related Art

A computer printer includes a paper or print media feed system that transports print media, one sheet at a time, from a supply source such as a paper tray to a print zone where a printer mechanism prints on the print media. Printer trays are snapped into place, slid into place, or otherwise attached to a printer housing. Printer trays variously include enclosed or open trays. Printer trays are often specifically sized to accommodate one, or a limited number of sizes of paper.

Some printers have printer trays that slide into and out of the printer to accommodate paper sizes. Sliding extensions of paper trays are used to accommodate lengthier paper.

A problem with many input trays is that they are detachable and have to be separately stored.

Another problem is that different trays are needed to accommodate different sizes of paper.

Another problem with input trays on printers is that they do not aesthetically store on the printer itself.

What is needed in the art is an apparatus that can be easily adjusted to accommodate different sizes of paper on a printer and be self-stowing on the printer.

SUMMARY OF THE INVENTION

The present invention provides an apparatus and a method for utilizing a split paper support that stows on the printer.

The invention, in one form thereof, relates to a printer paper support system including a housing, a first paper support pivotally attached to the housing and a second paper support pivotally attached to the housing, the second paper support extending the first paper support.

The invention, in another form thereof, relates to a printer including a housing, a first paper support pivotally attached to the housing and a second paper support pivotally attached to the housing or the first paper support. The first paper support and the second paper support co-act to support a supply of paper.

The invention, in still another form thereof, relates to a printer including a housing and a plurality of paper supports pivotally connected to the housing about a common axis.

The invention, in yet another form thereof, relates to a method of positioning paper supports on a printer including the steps of pivotally positioning a first paper support and pivotally positioning a second paper support to coact with the first paper support to support a supply of paper.

An advantage of the present invention is that both a small and large paper support is self-stowing on the printer apparatus itself.

Another advantage of the present invention is that the small paper support can be used by itself to support smaller pieces of paper and the large paper support can co-act with the small paper support to support larger pieces of paper.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
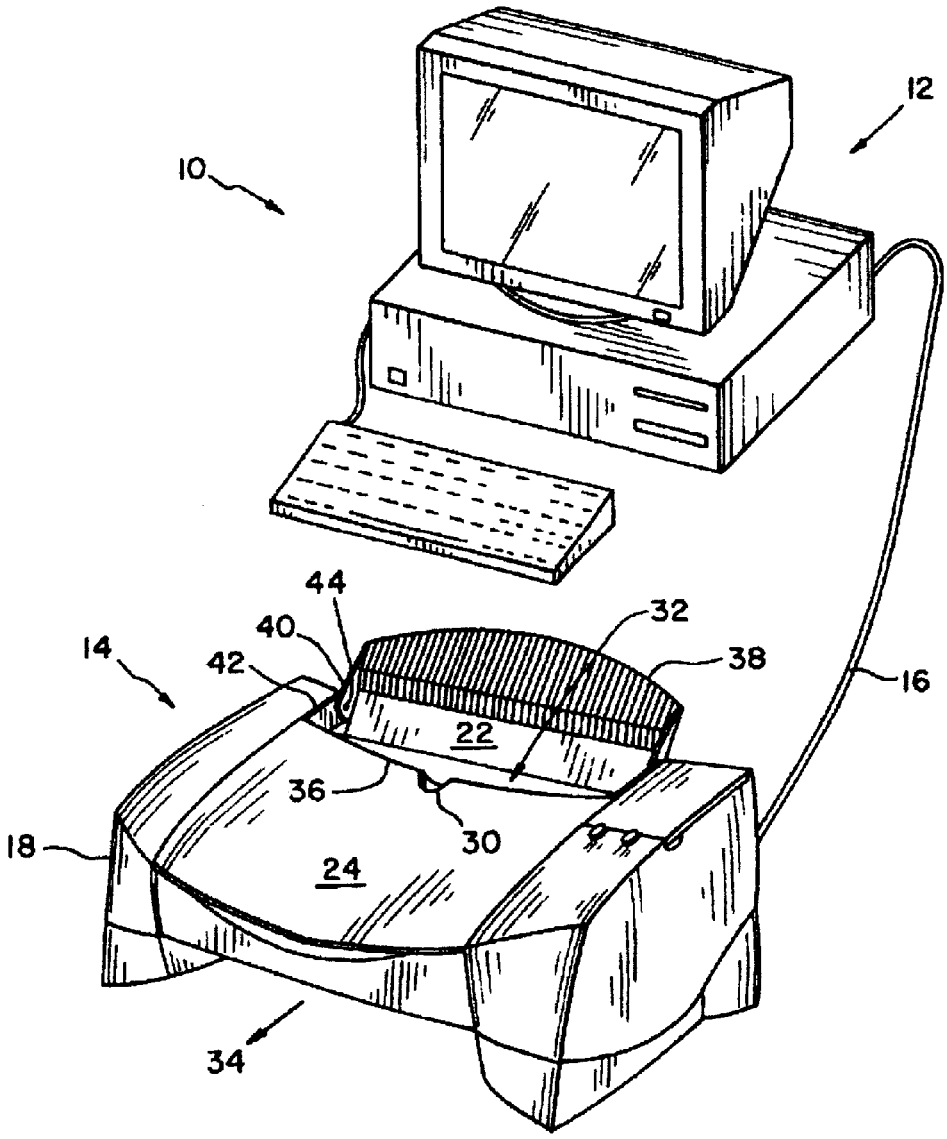
FIG. 1 is a perspective view of an imaging system having a printer that incorporates an embodiment of the paper supports of the present invention.
Figure 2:
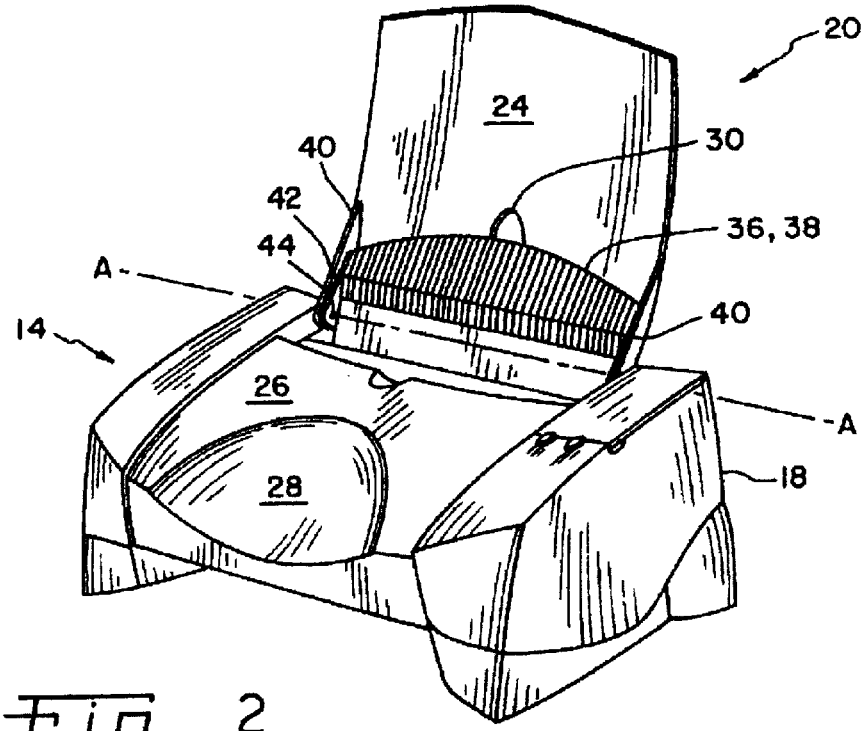
FIG. 2 is a perspective view of the printer of FIG. 1 having the paper supports in a raised position.
Figure 3:
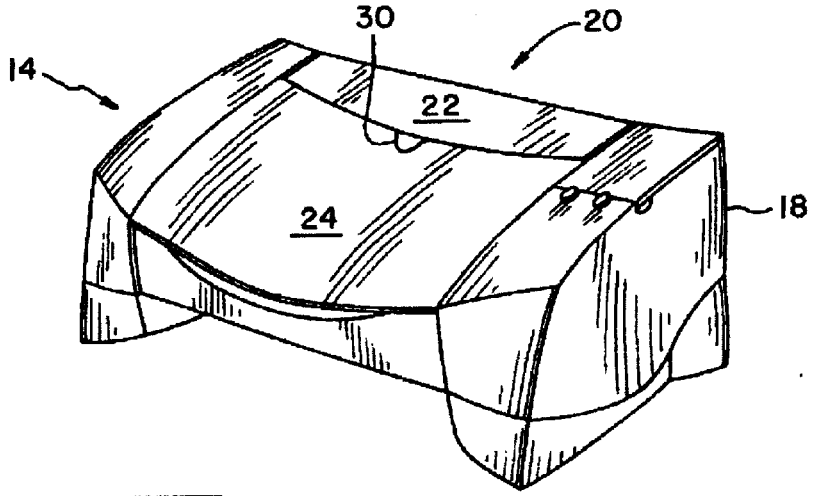
FIG. 3 is a perspective view of the printer of FIGS. 1 and 2 with the paper supports in a stowed position.

Referring now to the drawings and particularly to FIGS. 1–3, there is shown an imaging system 10 including a computer 12, a printer 14 and a communication connection 16. Computer 12 is coupled to printer 14 by way of communication connection 16. Communication connection 16 may be a point-to-point electrical cable connection between either a serial or parallel port of printer 14 and computer 12. Alternatively, an infrared transceiver unit at each of printer 14 and computer 12 can be used to transmit data therebetween. Also alternatively, communication connection 16 can be a network connection such as an Ethernet network. Computer 12 includes application software operated by a user and provides image data representing an image to be printed and printing command data to printer 14 by way of communication link connection 16.

Printer 14 includes a printer housing 18 and a printer paper support system 20 (see FIG. 2). Printer paper support system 20 includes a small paper support 22, a large paper support 24, a stowage area 26 and a small support lift access 30. Printer housing 18 provides an access port 32 for paper to be input into printer 14 and an exit route 34 for paper exiting from printer 14 after being printed upon. Small paper support 22 and large paper support 24 are pivotally connected to printer housing 18 proximate to paper access port 32. Printer housing 18 has a stowage area 26 where small and large paper supports 22 and 24 are stowed when not needed to support paper. While supports 22 and 24 are described generally as paper supports for convenience, those skilled in the art will recognize that print media other than paper can be supported by paper supports 22, 24.

Small paper support 22 is pivotally connected at each end to printer housing 18. Small paper support 22 is rotatable to a raised position to accommodate input paper into printer 14. When not in use small paper support 22 can be rotatably stowed in stowage area 26, which effectively closes paper access port 32. Alternatively, an opening slot along the bottom of small paper support 22 allows small pieces of paper to be input directly into printer 14 when small paper support 22 is in a stowed orientation.

Large paper support 24 is stored in stowage area 26 when not needed to accommodate large pieces of paper. To feed large pieces of paper into printer 14, large paper support 24 is rotatably raised to a support position in concert with small paper support 22 thereby extending the paper supporting ability of small paper support 22. When small paper support 22 and large paper support 24 are positioned in stowage area 26, small support lift access 30, which is located along an edge of large paper support 24 allows user access to lift small paper support 22, thereby allowing the user to raise small paper support 22.

Stowage area 26 is an area on printer housing 18 that allows an aesthetic stowage of small paper support 22 and large paper support 24. Stowage area 26 is, as shown in FIG. 2, a slightly recessed area shaped to accommodate the thickness of paper supports 22 and 24. Along a front edge of printer 14 a depression 28 in stowage area 26 allows easy ergonomic access to the front edge of large paper support 24 in order to allow the pivotal raising of large paper support 24. Alternatively, the raising of large paper support 24 will cause small paper support 22 to rise due to the interaction of a lower edge 36 of large paper support 24 with an upper edge 38 of small paper support 22.

Small paper support 22 and large paper support 24 are co-pivotally attached to printer housing 18 along axis A. Alternatively, small paper support 22 and large paper support 24 may be pivotal about separate axes yet meeting in a raised support position, as shown in FIG. 2, to support a supply of paper in a coordinated manner.

Large paper support 24 has large paper support arms 40 attached thereto. In a similar fashion small paper support 22 has small paper support arms 42 attached thereto. Support arms 40 and support arms 42 are the portion of paper supports 22 and 24 that are pivotally attached to printer housing 18. Support arms 40 and 42 properly space and position paper supports 22 and 24 to allow small paper support 22 and large paper support 24 to co-act in supporting input paper to printer 14. Hinge 44, located on each side of printer housing 18, is the point where support arms 40 and 42 are coaxially connected along axis A. Alternatively, support arms 40 or support arms 42 may be hingedly attached to each other, with either support arms 40 or 42 being pivotally attached to printer housing 18.

Small paper support 22 is selected by a user for the use of printer 14 by simply inserting a finger into small support lift access 30 of printer 14 and lifting small paper support 22. Small paper support 22 is lifted to a raised position, as shown in FIG. 1, allowing letter size and smaller paper to be positioned and supported thereby. If the choice is to use larger size paper, such as A3, the user lifts large paper support 24 into a raised position, as shown in FIG. 2. Paper is then inserted into printer 14 and supported by both small paper support 22 and large paper support 24.

Paper supports 22 and 24 interact such that small paper support 22 cannot be stowed in stowage area 26 unless large paper support 24 is already positioned in stowage area 26. The interaction extends to include the contemporaneous raising of small paper support 22 when large paper support 24 is moved to a raised position.

Although small paper support 22 and large paper support 24 have been described as input paper trays, a similar apparatus can be used to implement output paper trays. When small paper support 22 and large paper support 24 are in their stowed position they form an aesthetically pleasing closed look to printer 14. In a like manner when large printer support 24 is in stowed position as in FIG. 1 the aesthetically pleasing look continues even though one paper tray support is in use and the other is in a stowed position. When both paper supports 22 and 24 are in a raised position, stowage area 26 is configured to provide a smooth, pleasing look to printer 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printer paper support system, comprising:

a housing;

a first paper support pivotally attached to said housing; and a second paper support pivotally attached to said housing, said second paper support extending said first paper support, said first paper support and said second paper support each have a raised position and a stowed position, wherein said second paper support and said first paper support interact such that the movement of said second paper support to said raised position causes said first paper support to contemporaneously move to said raised position.

2. A printer, comprising:

a housing;

a first paper support pivotally attached to said housing; and a second paper support pivotally attached to one of said housing and said first paper support, said first paper support and said second paper support co-acting to support a supply of paper, said first paper support and said second paper support each have a raised position and a stowed position, wherein said second paper support and said first paper support interact such that the movement of said second paper support to said raised position causes said first paper support to contemporaneously move to said raised position.

3. A printer, comprising:

a housing; and a plurality of paper supports pivotally connected to said housing to pivot about a common axis;

wherein said plurality of paper supports includes a first paper support and a second paper support, and wherein said housing includes a surface stowage area where said first paper support and said second paper support are rotateably stowed;

wherein said first paper support and said second paper support each have a raised position and a stowed position; and wherein said second paper support and said first paper support interact such that the movement of said second paper support to said raised position causes said first paper support to contemporaneously move to said raised position.

* * * * *